US007036816B2

(12) United States Patent
Abe

(10) Patent No.: US 7,036,816 B2
(45) Date of Patent: May 2, 2006

(54) PAPER FEEDING CASSETTE FOR IMAGE FORMING APPARATUS

(75) Inventor: Shingo Abe, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 255 days.

(21) Appl. No.: 10/650,978

(22) Filed: Aug. 29, 2003

(65) Prior Publication Data

US 2004/0041335 A1 Mar. 4, 2004

(30) Foreign Application Priority Data

Aug. 29, 2002 (JP) ..... P2002-251372

(51) Int. Cl.
*B65H 1/00* (2006.01)

(52) U.S. Cl. ..... 271/171; 271/223

(58) Field of Classification Search ..... 271/171, 271/223

See application file for complete search history.

(56) References Cited

U.S. PATENT DOCUMENTS 4,032,136 A * 6/1977 Komaba et al. ..... 271/160
4,106,763 A * 8/1978 Tani et al. ..... 271/9.01
4,874,159 A * 10/1989 Maeno et al. ..... 271/171
5,238,238 A * 8/1993 Shinohara et al. ..... 271/145
5,927,707 A * 7/1999 Miura ..... 271/171

FOREIGN PATENT DOCUMENTS

JP 4197927 A * 7/1992
JP 5286577 A * 11/1993
JP 640580 A * 2/1994
JP 7-309458 A 11/1995
JP 10-77123 A 3/1998

* cited by examiner

*Primary Examiner*—David H. Bollinger
(74) *Attorney, Agent, or Firm*—Birch, Stewart, Kolasch & Birch, LLP

(57) ABSTRACT

The paper feeding cassette includes a push-up plate provided inside the cassette for receiving a stack of sheets entirely thereon regardless of the size of the sheets. On the push-up plate is mounted a trailing edge plate which is coupled to a fixing plate through a slide groove and which is configured to be capable of sliding in a sheet feeding direction in which the stacked sheets are to be fed to restrict the position of the stack of the sheets in the sheet feeding direction. The trailing edge plate is provided, at opposite sides thereof, with stoppers to be inserted into positioning holes of the push-up plate for fixing the trailing edge plate.

10 Claims, 7 Drawing Sheets

PAPER FEEDING CASSETTE FOR IMAGE FORMING APPARATUS

This Nonprovisional application claims priority under 35 U.S.C. § 119(a) on Patent Application No. 2002-251372 filed in Japan on Aug. 29, 2002.

BACKGROUND OF THE INVENTION

1. Field of the Invention

The present invention relates to a paper feeding cassette for use in an image forming apparatus such as a facsimile apparatus, which has a structure allowing the user to change the size of sheets to be accommodated therein as desired by the user.

2. Description of the Related Art

Conventionally, a paper feeding cassette for use in an image forming apparatus such as a facsimile apparatus has a structure capable of accommodating sheets of various sizes as desired by the user. Further, such a paper feeding cassette is so structured as to be capable of restricting the width and the feeding orientation of sheets to be accommodated in accordance with the size of the sheets for preventing the occurrence of paper jam or the like due to feeding of such a sheet in a skewed fashion.

A prior art paper cassette capable of restricting the feeding orientation of sheets accommodated in the cassette is disclosed in Japan Patent Laid Open Publication Hei No. 7-309458. In the paper cassette disclosed in this patent publication, a bottom plate bearing the leading edge side of a stack of sheets thereon is pressed upward by a spring to bring the sheets into contact with a sheet feeding roller, while a rear plate attached to the paper feeding cassette restricts the position of the trailing edge of the stack of sheets. On the other hand, Japan Patent Laid Open Publication Hei No. 10-77123 discloses a paper cassette in which a push-up plate bearing a stack of sheets entirely thereon is pressed upward by a spring to bring the sheet stack into contact with a sheet feeding roller, while a trailing edge guide removably attached to the push-up plate restricts the position of the trailing edge of the sheet stack.

In the structure of the paper feeding cassette disclosed in Japan Patent Laid Open Publication Hei No. 7-309458, the bottom plate needs to be located so as not to interfere with the rear plate. Therefore, the space allowing the rear plate to be disposed therein is limited, and the rear plate needs to be located closer to the front side of the cassette as the size of sheets used becomes smaller. Therefore, the bottom plate located so as not to interfere with the rear plate has to be inclined at a relatively large angle (inclination), which causes the sheets stacked thereon to be warped. When the sheets are warped, their frictional resistance increases, which may cause a failure of the sheet feeding roller in catching a sheet before feeding. Further, if sheets are accommodated in the paper feeding cassette for a long period, such sheets become kept in a warped state, which may cause paper jam in transferring the sheets.

On the other hand, the paper feeding cassette disclosed in Japan Patent Laid Open Publication Hei No. 10-77123 is so structured to receive a stack of sheets entirely on the push-up plate provided with the trailing edge guide thereon. Therefore, unlike the paper feeding cassette disclosed in Japan Patent Laid Open Publication Hei No. 7-309458, warping of sheets will not occur, which prevents the catching failure of the sheet feeding roller as well as paper jam in transferring the sheets.

However, since the trailing edge guide is mounted as inserted in the push-up plate, the cassette can hold only sheets of predetermined sizes and hence cannot accommodate sheets of nonstandard sizes. Further, the trailing edge guide is detachable from the push-up plate and can be stored in the paper feeding cassette when unnecessary, which may cause the trailing edge guide to be lost.

SUMMARY OF THE INVENTION

It is, therefore, an object of the present invention to provide a paper feeding cassette which is capable of solving the problems described above, which prevents sheets accommodated therein from becoming kept in a warped state, which has a simple structure and enables easy positional adjustment, and which is provided with a trailing edge guide plate which is unlikely to be lost.

In accordance with the present invention, there is provided a paper feeding cassette for an image forming apparatus, comprising: a push-up plate for receiving a stack of sheets entirely thereon, the push-up plate being operative to bring one of the sheets to be fed into contact with a sheet feeding roller provided in the image forming apparatus with a predetermined push-up pressure; and a trailing edge plate mounted to the push-up plate for restricting the position of a trailing edge of the stack of sheets, the trailing edge plate being slidable in a sheet feeding direction to a position in accordance with a sheet size.

In this construction, the trailing edge plate for restricting the trailing edge of the stack of sheets entirely loaded on the push-up plate is mounted to the push-up plate and is slidable in the sheet feeding direction. Since the trailing edge plate can slide to an appropriate position in accordance with the size of sheets, sheets of desired sizes can be used. Further, since the paper feeding cassette of the present invention is configured to receive the stack of sheets entirely on the push-up plate, the sheets will not be warped, which can prevent paper jam to occur in transferring the sheets. Moreover, the trailing edge plate, which is mounted to the push-up plate, cannot be removed from the push-up plate, which eliminates the possibility of losing the trailing edge plate.

The foregoing and other objects, features and attendant advantages of the present invention will become more apparent from the reading of the following detailed description of the invention in conjunction with the accompanying drawings.

DETAILED DESCRIPTION OF THE PRESENT INVENTION

Figure 1:
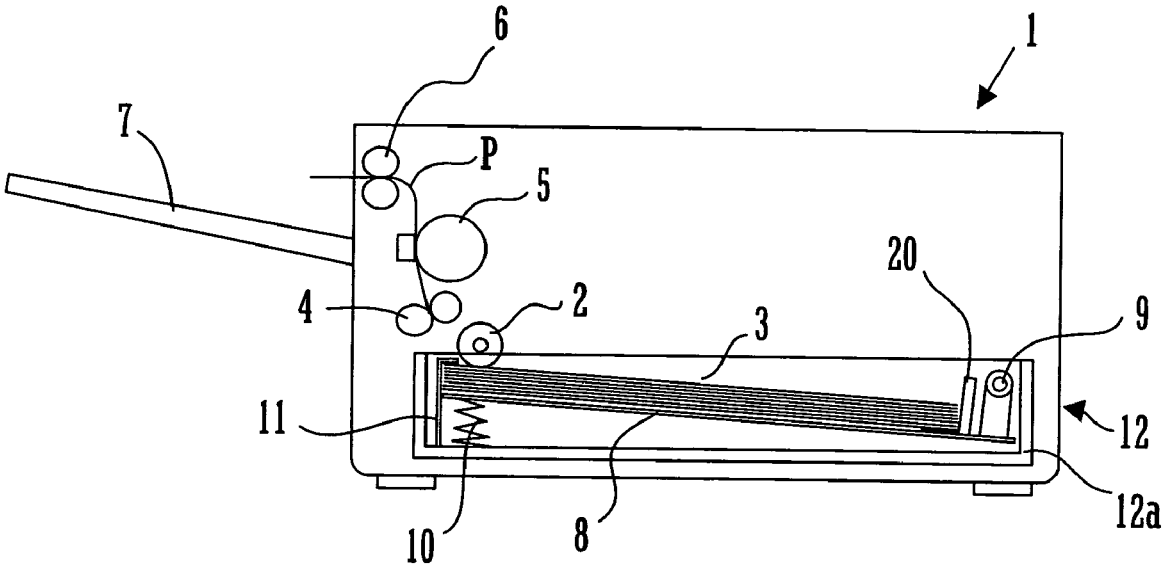
FIG. 1 is a schematic view illustrating the structure of a paper feed mechanism of a facsimile apparatus provided with a paper feeding cassette according to an embodiment of the present invention.
Figure 2:
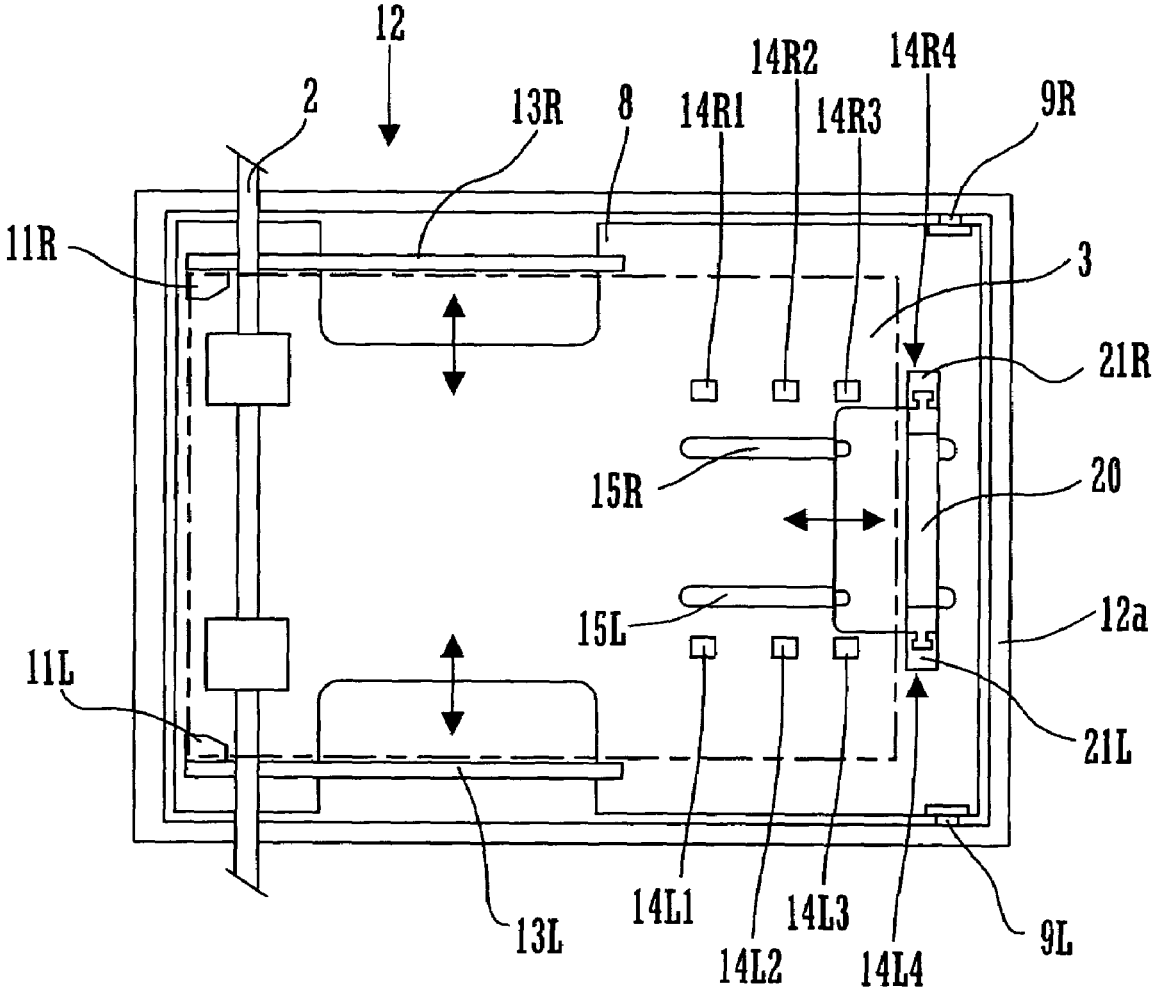
FIG. 2 is a top view schematically illustrating the construction of the paper feeding cassette according to the embodiment of the present invention.

Hereinafter, embodiments of the present invention will be described in detail with reference to the drawings. FIG. 1 is a schematic view illustrating the structure of a paper feed mechanism of a facsimile apparatus provided with a paper feeding cassette according to an embodiment of the present invention. FIG. 2 is a top view schematically illustrating the construction of the paper feeding cassette according to the embodiment of the present invention. It is to be noted that, in FIG. 2, the paper feeding cassette is illustrated together with a sheet feeding roller for describing the state of the cassette as fitted to the facsimile.

The facsimile apparatus 1 includes a paper feeding cassette 12 for accommodating a sheet stack 3, a sheet feeding roller 2 for feeding sheets P, sheet transfer rollers 4 and 6 for transferring the sheets P, a printing unit for printing received data and the like on the sheets P, and an ejected sheet tray 7 for receiving sheets P finished with printing.

Upon receiving data transmitted from a sender, the facsimile apparatus 1 causes the sheet feeding roller 2 to rotate so as to feed the uppermost sheet (sheet P) of the sheet stack 3 accommodated in the paper feeding cassette 12. Subsequently, the facsimile apparatus 1 causes the sheet transfer roller 4 to transfer the sheet P fed from the paper feeding cassette 12 to the printing unit 5 for printing the received data on the sheet P, and then causes the sheet transfer roller 6 to eject the sheet P printed with the received data into the ejected sheet tray 7.

As shown in FIG. 1, the facsimile apparatus 1 is so structured as to allow the paper feeding cassette 12 to be removably fitted thereto. However, the facsimile apparatus 1 is not limited to such a structure. The facsimile apparatus 1 may have a structure incorporating the paper feeding cassette 12 or may be provided with a multi-tier paper feeding cassette unit consisting of a plurality of paper feeding cassettes.

Description will be made of the construction of the paper feeding cassette 12. The paper feeding cassette 12 comprises a sheet case 12*a* in the form of a rectangular parallelepiped with open top, and a push-up plate 8 provided inside the sheet case 12*a*. The push-up plate 8 is capable of receiving stacked sheets of any size as long as the size of the sheets P forming the sheet stack 3 is not larger than A3 for example. The push-up plate 8 is pivotally supported at supporting portions 9L and 9R located adjacent a trailing edge of the sheet stacked 3. Further, the push-up plate 8 is pushed up at a lower portion thereof by a spring 10 provided adjacent an edge of the push-plate 8 on the side opposite to the support portions 9L and 9R. The push-up plate 8 is pushed upward with a predetermined push-up pressure regardless of the number of the sheets constituting the sheet stack 3, thereby constantly bringing the sheet stack 3 into contact with the sheet feeding roller 2. The position of the trailing edge of the sheet stack 3 is restricted by a trailing edge plate 20, whereas the positions of the opposite lateral edges of the sheet stack 3 are restricted by sheet guides 13L and 13R.

The sheet guides 13L and 13R are slidable in the widthwise direction of the sheet stack 3. Depending on the size of the sheet stack 3, the user can appropriately move the sheet guides 13L and 13R to bring the side surfaces of the respective sheet guides 13L and 13R into contact with the sheet stack 3, thereby restricting the widthwise position of the sheet stack 3.

The trailing edge plate 20 is slidable in the sheet feeding direction in which each sheet of the sheet stack 3 is to be fed. The push-up plate 8 is formed with slide grooves 15L and 15R each in the form of an elongate hole extending in the sheet feeding direction and positioning holes 14L1 to 14L4 and 14R1 to 14R4 arranged in the sheet feeding direction at intervals corresponding to sheet sizes. The trailing edge plate 20 is coupled to a non-illustrated fixing plate 22 through the slide grooves 15L and 15R. The trailing edge plate 20 has opposite sides attached with stoppers 21L and 21R which are vertically slidable.

The user can slide the trailing edge plate 20 so as to bring its side face into contact with the sheet stack 3, thereby restricting the position of the sheet stack 3 in the sheet feeding direction in accordance with the size of the sheet stack 3. Further, the trailing edge plate 20 can be fixed by inserting the stoppers 21L and 21R into an appropriate one of the positioning holes 14L1 to 14L4 and an appropriate one of the positioning holes 14R1 to 14R4, respectively. For example, when the sheets forming the sheet stack 3 are of B5 size, the stopper 21L is inserted into the positioning hole 14L1 and the stopper 21R inserted into the positioning hole 14R1. When the sheets forming the sheet stack 3 are of A4 size, the stopper 21L is inserted into the positioning hole 14L2 and the stopper 21R inserted into the positioning hole 14R2. When the sheets forming the sheet stack 3 are of B4 size, the stopper 21L is inserted into the positioning hole 14L3 and the stopper 21R inserted in the positioning hole 14R3. When the sheets forming the sheet stack 3 are of A3 size, the stopper 21L is inserted into the positioning hole 14L4 and the stopper 21R inserted into the positioning hole 14R4.

The front edge portion of the push-up plate 8 where the spring 10 is attached has opposite sides provided with separating pawls 11L and 11R. The separating pawl 11L is attached to an end of the sheet guide 13L, whereas the separating pawl 11R is attached to an end of the sheet guide 13R. The separating pawls 11L and 11R can be moved in accordance with the size of sheets used. In feeding sheets from the sheet stack 3 in the sheet feeding direction by the rotation of the sheet feeding roller 2 as described before, the separating pawls 11L and 11R separate the uppermost sheet from the rest of the sheet stack 3, thereby transferring only one sheet P.

When loading the paper feeding cassette 12 with a sheet stack, the paper feeding cassette 12 is first removed from the facsimile apparatus 1. Subsequently, a non-illustrated cassette cover as a top lid of the paper feeding cassette 12 is removed, and the push-up plate 8 is depressed so as to be held by a non-illustrated push-up plate stopper at the depressed position. Then, a stack of sheets of a desired size is placed on a central portion of the push-up plate 8 of the paper feeding cassette 12. At that time, while bringing the leading edge of the sheet stack into contact with the side surfaces of the separating pawls 11L and 11R, the sheet guides 13L and 13R are slid from opposite sides toward the center line of the sheet stack to sandwich the sheet stack. Further, with the stoppers 21L and 21R at opposite sides of the trailing edge plate 20 slid upward, the trailing edge plate 20 is slid along the slide grooves 15L and 15R until it comes into contact with the sheet stack. After the trailing edge plate 20 has been moved to the trailing edge of the sheet stack, the stoppers 21L and 21R are slid downward for insertion into relevant ones of the positioning grooves 14L1 to 14L4 and the positioning grooves 14R1 to 14R4, thereby fixing the trailing edge plate 20. Subsequently, the non-illustrated cassette cover is fitted to the paper feeding cassette 12, and the paper feeding cassette 12 is set on the facsimile apparatus 1. When the paper feeding cassette 12 is set on the facsimile apparatus 1, a non-illustrated release mechanism operates to release the push-up plate 8 from the push-up plate stopper. Thus, the push-up plate 8 is pivotally moved about the supporting portions 9L, 9R by the spring 10 so that it is raised up to a position where the sheet stack is brought into contact with the sheet feeding roller 2.

Figure 3:
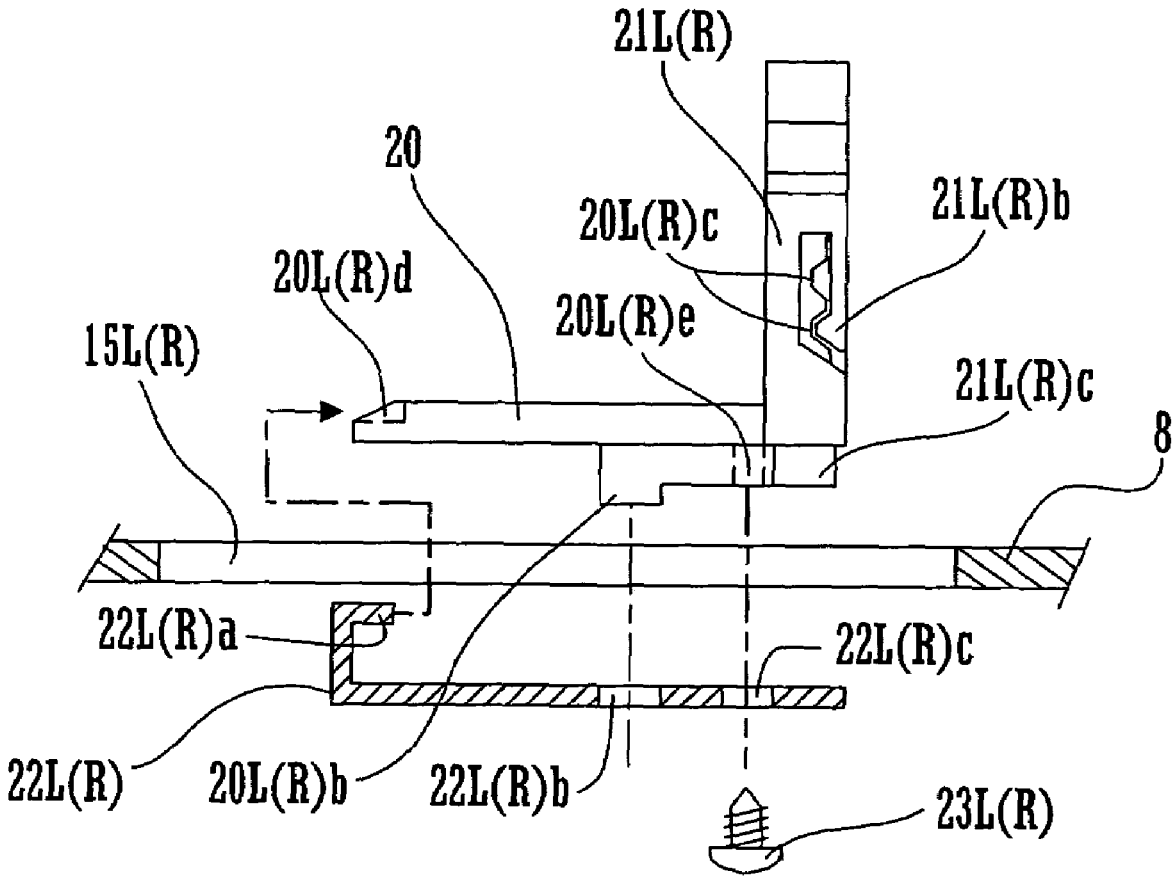
FIG. 3 is a fragmentary front elevational view illustrating how to mount a trailing edge plate to a push-up plate.
Figure 4:
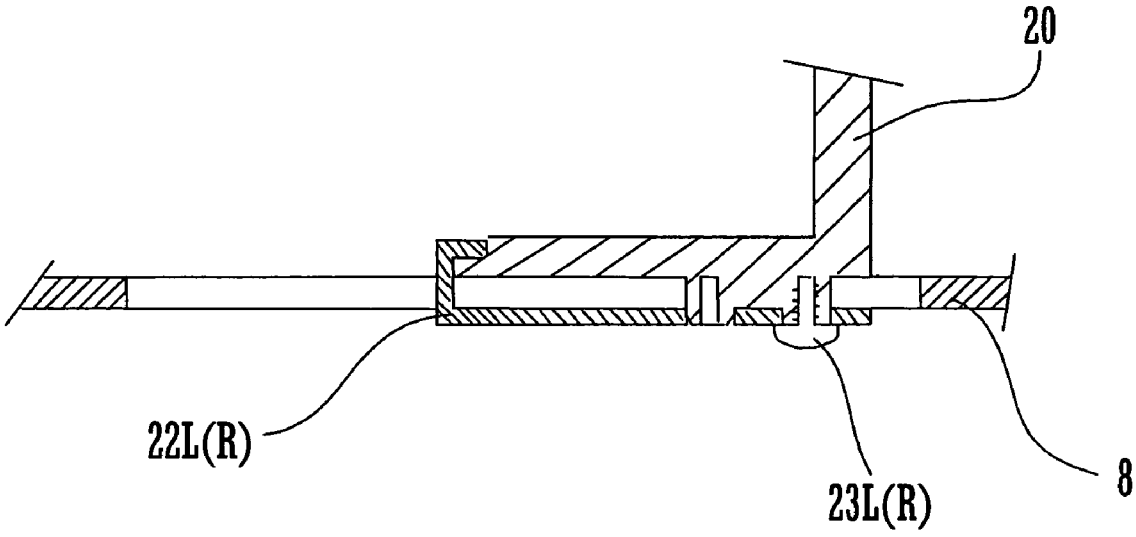
FIG. 4 is a fragmentary sectional view illustrating the structure formed after the mounting of the trailing edge plate to the push-up plate.
Figure 5:
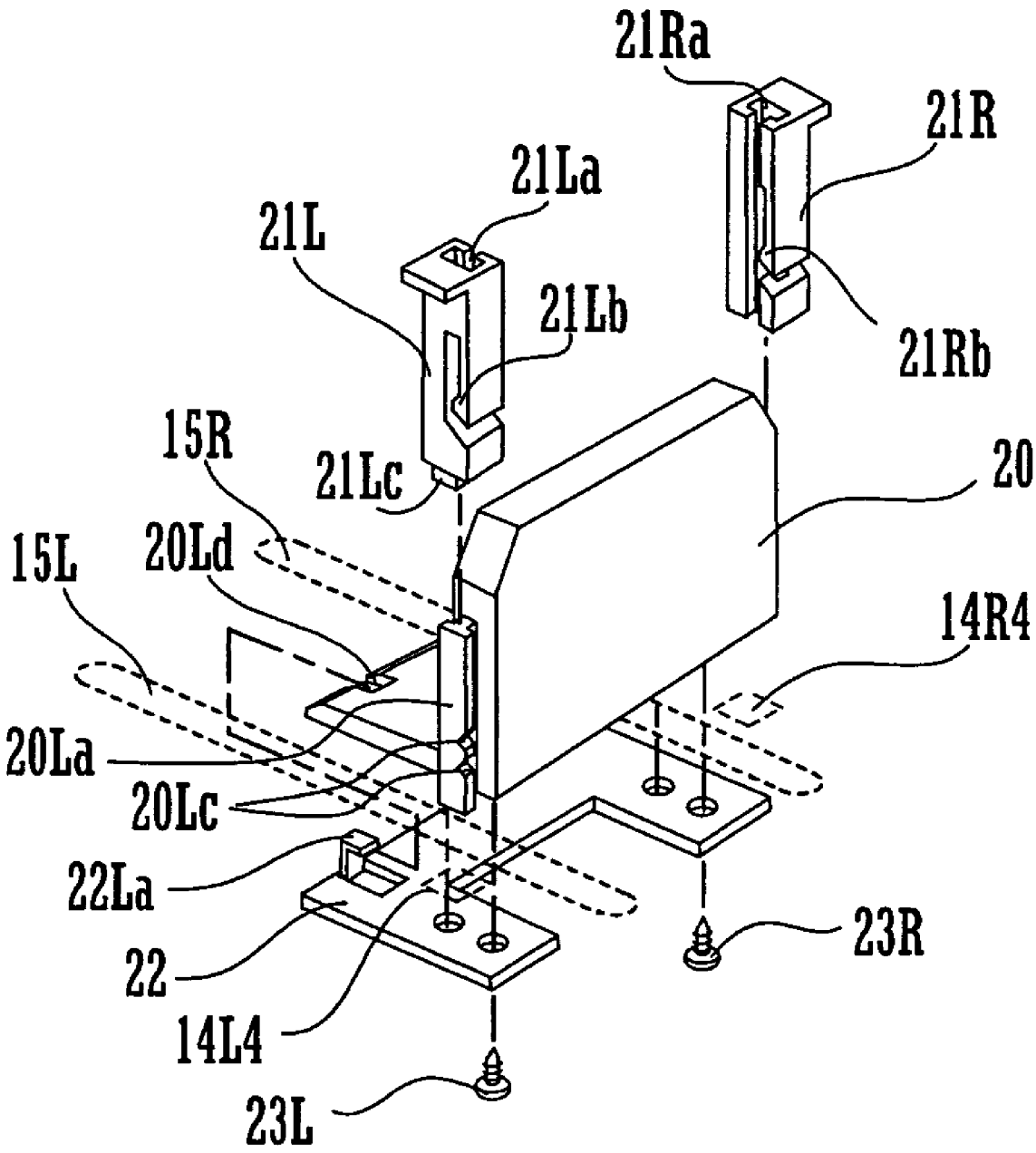
FIG. 5 is an exploded view of a portion including the trailing edge plate, fixing plate and stoppers.

Next, the structure of the trailing edge plate 20 is described with reference to FIGS. 3 to 5. FIG. 3 is a fragmentary front elevational view illustrating how to mount a trailing edge plate to a push-up plate. FIG. 4 is a fragmentary sectional view illustrating the structure formed after the mounting of the trailing edge plate to the push-up plate. FIG. 5 is an exploded view of a portion including the trailing edge plate, fixing plate and stoppers. In the description given below, each L-portion and a corresponding R-portion are represented collectively. For example, the stopper 21L and the stopper 21R are represented as stopper 21L(R).

A sliding mechanism and a fixing mechanism for the L-shaped trailing edge plate are assembled in the following manner. Firstly, as shown in FIG. 5, a projection 20L(R)a provided at an edge of the trailing edge plate 20 is fixedly inserted into a groove 21L(R)a formed in the stopper 21L(R). Subsequently, as shown in FIG. 3, the trailing edge plate 20 to which the stopper 21L(R) is attached is placed so that a positioning boss 20L(R)b formed at the bottom surface of the trailing edge plate 20 is fitted into the slide groove 15L(R) of the push-up plate 8. Then, the fixing plate 22 is secured to the trailing edge plate 20 from the bottom side of the push-up plate 8. At that time, positioning is made by fitting a front edge portion 22L(R)a of the fixing plate 22 to a front edge portion 20L(R)d of the trailing edge plate 20 followed by inserting the positioning boss 20L(R)b located at the bottom surface of the trailing edge plate 20 into a boss hole 22L(R)b of the fix plate 22. Further, as shown in FIG. 4, each of two screws 23L(R) is fitted into a tapped hole 20L(R)e of the trailing edge plate 20 through a hole 22L(R)c.

The projection 20L(R)a at each of opposite edges of the trailing edge plate 20 is formed with a W-shaped fixing groove 20L(R)c, and the stopper 21L(R) attached to the trailing edge plate 20 is provided with a latch 21L(R)b to be fitted in the fixing groove 20L(R)c. In sliding the trailing edge plate 20, the stopper 21L(R) is slid upward. At that time, the stopper 21L(R) is fixed with the latch 21L(R)b fitted in an upper stepped portion (upper end) of the fixing groove 20L(R)c, thereby allowing the sliding of the trailing edge plate 20 in the sheet feeding direction. At a predetermined position corresponding to the size of sheets used, the stopper 21L(R) is slid downward. At that time, the stopper 21L(R) is fixed with the latch 21L(R)b fitted in a lower stepped portion (lower end) of the fixing groove 20L(R)c while a projection 21L(R)c formed at the bottom surface of the stopper 21L(R) is inserted into a relevant one of the positioning holes 14L1 to 14L4 or 14R1 to 14R4 of the push-up plate 8. Since the stopper 21L(R) is fixed in this way, the trailing edge plate 20 becomes unable to slide with its position fixed.

In the paper feeding cassette 12, it is possible to fix the trailing edge plate 20 at any desired position by utilizing a magnet lock, for example. Therefore, even when sheets of a nonstandard size are used, the trailing edge plate 20 can be slid to and fixed at any suitable position.

Figure 6:
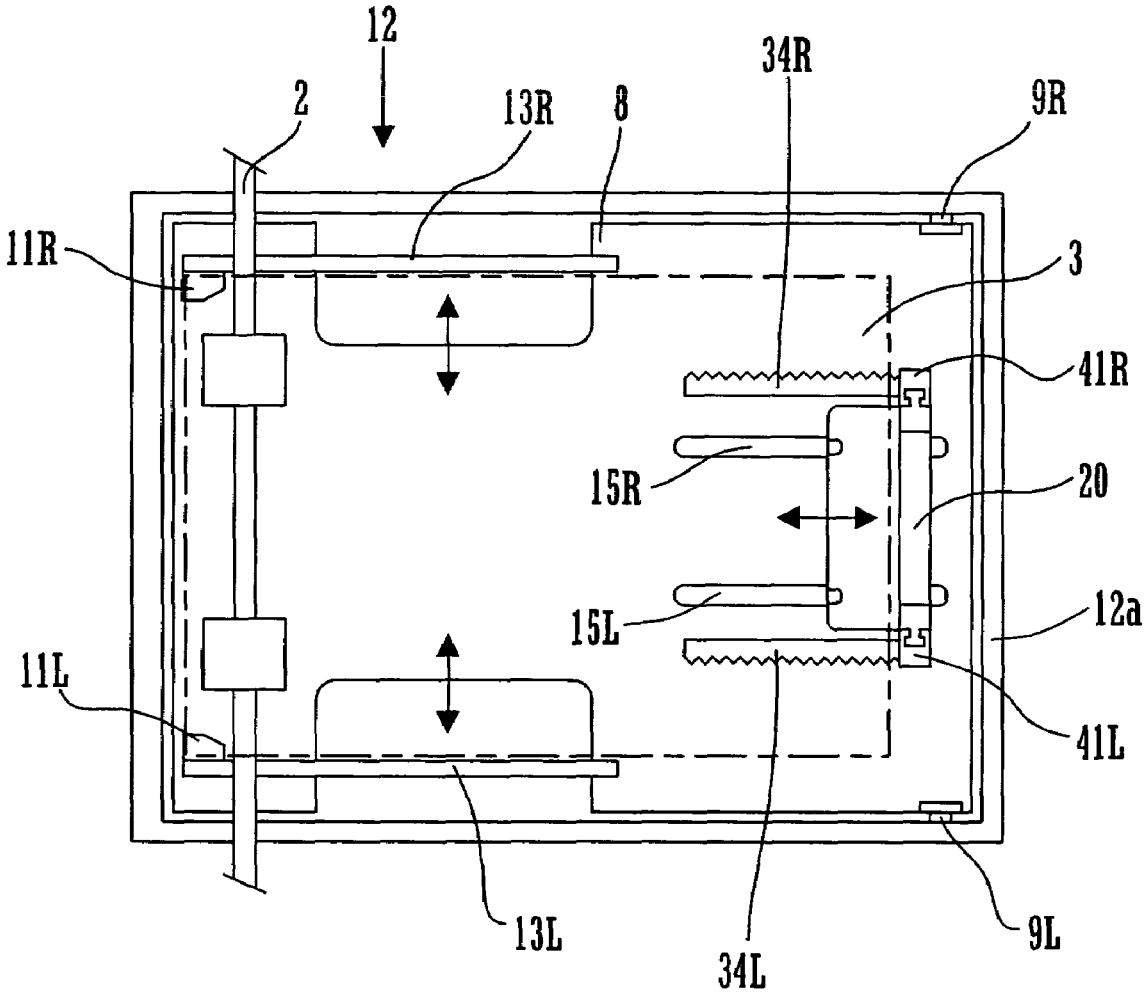
FIG. 6 is a top view schematically illustrating the construction of a paper feeding cassette according to an embodiment of the present invention, which differs from that shown in FIG. 2.
Figure 7:
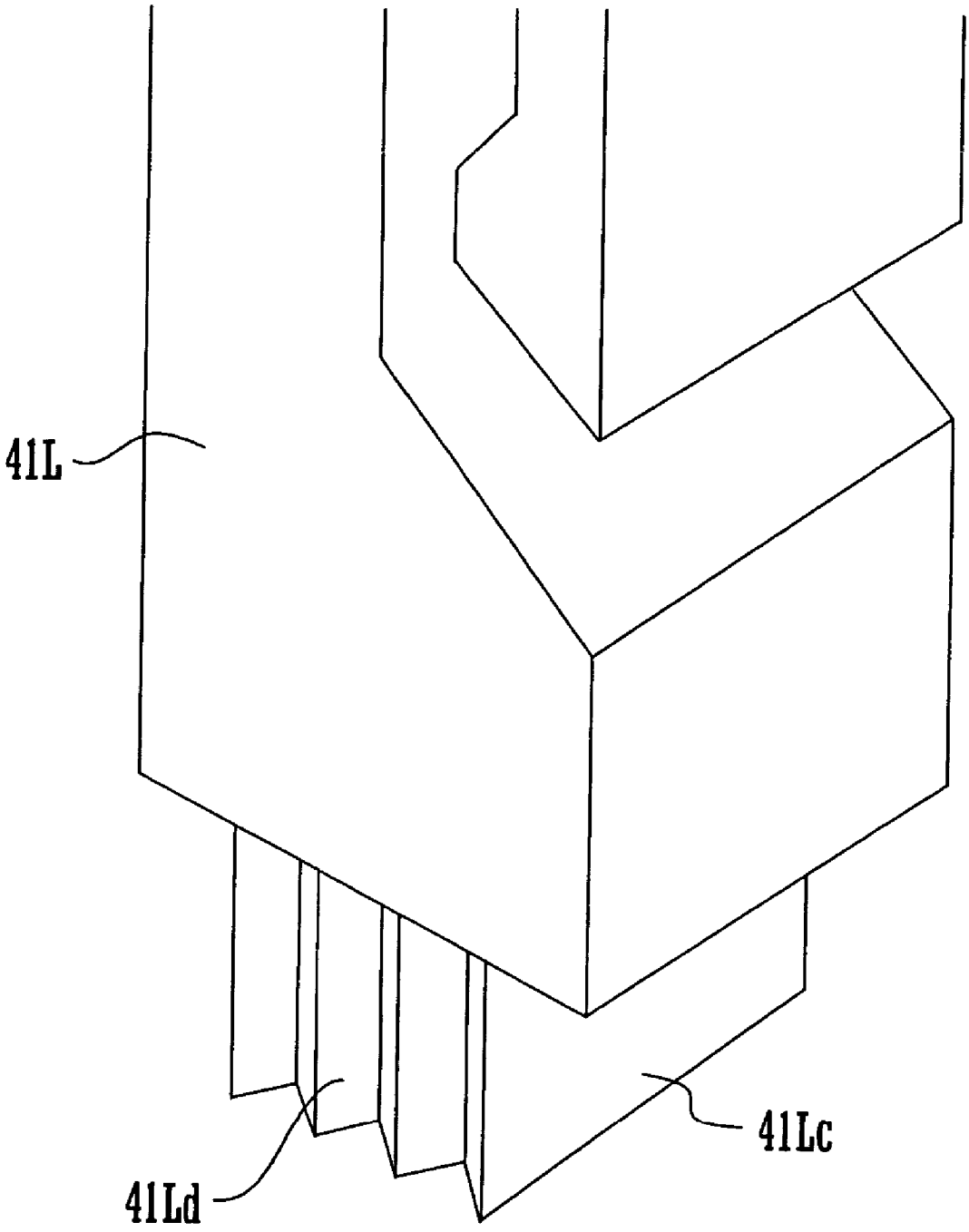
FIG. 7 is a fragmentary perspective view showing the outward form of a stopper of a trailing edge plate.

Alternatively, the trailing edge plate 20 may be fixed in the following manner. FIG. 6 is a top view schematically illustrating the construction of a paper feeding cassette according to an embodiment of the present invention, which differs from that shown in FIG. 2. FIG. 7 is a fragmentary perspective view showing the outward form of a stopper of the trailing edge plate. It is to be noted that, although only a stopper 41L is shown in FIG. 7, a stopper 41R has the same form.

As shown in FIG. 6, instead of the positioning holes 14, the push-up plate 8 is formed with a waved groove 34L(R) having one side which is entirely configured into triangular waves. Further, a stopper 41L(R) is used instead of the stopper 21L(R). Since other features are similar to the corresponding features of the paper feeding cassette 12 shown in FIG. 2, the description thereof is omitted. As shown in FIG. 7, the stopper 41L(R) includes a projection 41L(R)c having a surface 41L(R)d for contact with the waved groove 34L(R), the surface 41L(R) being formed with triangular waves for meshing with the waved groove 34L(R).

The projection 41L(R)c of the stopper 41L(R) can be inserted into the wave-shaped groove 34L(R) at any desired position. Therefore, the trailing edge plate can be fixed at an appropriate position corresponding to a sheet size for restricting the position of the trailing edge of a sheet stack.

As described above, in the paper feeding cassette according to the present invention, necessary units can be collected on the push-up plate, which leads to enhanced productivity. Further, since a sheet stack can be entirely received on the push-up plate, the sheets forming the sheet stack will not be warped, which can obviate paper jam in transferring the sheets. Moreover, since the paper feeding cassette is so structured as to allow the trailing edge plate to slide to an appropriate position in accordance with a sheet size, there is no possibility of losing the trailing edge plate.

As described above, the paper feeding cassette for an image forming apparatus according to the present invention has the following advantages.

Since the trailing edge plate can slide to an appropriate position in accordance with the size of sheets, sheets of a desired size can be used. Further, since the paper feeding cassette of the present invention is configured to receive a stack of sheets entirely on the push-up plate, the sheets will not be warped, which can prevent paper jam to occur in transferring the sheets. Moreover, since the trailing edge plate is mounted to the push-up plate, the trailing edge plate cannot be removed from the push-up plate, which eliminates the possibility of losing the trailing edge plate.

Further, the paper feeding cassette is configured to allow the trailing edge plate to slide in the sheet feeding direction along the elongate holes or grooves.

The push-up plate is formed with a plurality of holes at positions corresponding to different sheet sizes. Therefore, the trailing edge plate having slid to a position corresponding to the size of the sheets to be used can be fixed to that position by the stoppers thereby restricting the position of the trailing edge of a stack of the sheets. In the case where the push-up plate is formed with the grooves, the stoppers can be inserted into the respective grooves at any position, which makes it possible to restrict the position of the trailing edges of sheets of a nonstandard size. Thus, the paper feeding cassette of the present invention is capable of restricting the position of the trailing edges of sheets regardless of the size of the sheets and hence can obviate the occurrence of paper jam or paper feed failure.

The stoppers are vertically slidable in a range between the lowermost position where the stoppers are inserted into the grooves or holes for fixing the trailing edge plate and the uppermost position where the stoppers are kept as not inserted into the grooves or holes for allowing the trailing edge plate to slide. Therefore, it is not necessary to hold the stoppers in sliding the trailing edge plate, which makes it easy to slide the trailing edge plate. Further, it is possible to prevent the trailing edge plate from sliding unintentionally due to spontaneous detachment of the stoppers from the trailing edge plate in a fixed state.

While only certain presently preferred embodiments of the present invention have been described in detail, as will be apparent for those skilled in the art, certain changes and modifications may be made in embodiments without departing from the spirit and scope of the present invention as defined by the following claims.

What is claimed is:

1. A paper feeding cassette for an image forming apparatus, comprising:

a push-up plate for receiving a stack of sheets entirely thereon, the push-up plate being operative to bring the stack of sheets into contact with a sheet feeding roller provided in the image forming apparatus with a predetermined push-up pressure;

a trailing edge plate mounted to the push-up plate for restricting the position of a trailing edge of the stack of sheets, the trailing edge plate being slidable in a sheet feeding direction to a position in accordance with a sheet size;

a fixing member for preventing the trailing edge from removing from the push-up plate; and a stopper slidably attached to the trailing edge plate and adapted to selectively engage with the push-up plate to fix the trailing edge plate at desired positions on the push-up plate.

2. The paper feeding cassette in accordance with claim 1, wherein, the push-up plate is formed with an elongated hole or a groove extending in the sheet feeding direction; and the trailing edge plate is coupled to the fixing member through the elongated hole or the groove.

3. The paper feeding cassette in accordance with claim 1, wherein, the push-up plate is formed with a groove extending in the sheet feeding direction for receiving the stopper therein to fix the trailing edge plate.

4. The paper feeding cassette in accordance with claim 1, wherein the stopper is vertically slidable within a predetermined range, the paper feeding cassette further comprising:

a holding mechanism for holding the stopper at one of upper and lower ends of the predetermined range.

5. The paper feeding cassette in accordance with claim 1, wherein the stopper is provided at a side in a lateral direction of the trailing edge plate.

6. The paper feeding cassette in accordance with claim 1, wherein, the push-up plate is formed with a plurality of holes arranged in the sheet feeding direction for receiving the stopper therein to fix the trailing edge plate.

7. The paper feeding cassette in accordance with claim 1, wherein the trailing edge plate is provided with a projection and the stopper is provided with a groove formed in the stopper, such that the projection engages with the stopper to allow the stopper to slide upward or downward within a predetermined range.

8. The paper feeding cassette in accordance with claim 7, wherein the projection is provided with one or more fixing grooves adapted to engage with a latch formed in the stopper to hold the latch at an upper end or a lower end of the predetermined range.

9. A paper feeding cassette for an image forming apparatus, comprising:

a push-up plate for receiving a stack of sheets entirely thereon, the push-up plate being operative to bring the stack of sheets into contact with a sheet feeding roller provided in the image forming apparatus with a predetermined push-up pressure, the push-up plate being provided with an elongated groove that extends in a sheet feeding direction;

a trailing edge plate mounted on a upper surface of the push-up plate for restricting the position of a trailing edge of the stack of sheets, the trailing edge plate being slidable in the sheet feeding direction to a position in accordance with a sheet size, and provided with a protruding member extending in the sheet feeding direction; and a fixing member coupled to the trailing edge plate from underneath the push-up plate and through the elongated groove, the fixing member having a front edge portion that engages with a front end portion of the protruding member.

10. The paper feeding cassette in accordance with claim 9, wherein the trailing edge plate is provided with a positioning boss that extends through the elongated groove and fixed to the fixing member.

* * * * *